United States Patent [19]

Parr

[11] 4,239,313

[45] Dec. 16, 1980

[54] SWIVEL CONNECTOR

[76] Inventor: William W. Parr, 313 Little Ave., Barrie, Ontario, Canada, L4N 2Z8

[21] Appl. No.: 960,570

[22] Filed: Nov. 14, 1978

[51] Int. Cl.[3] ..... H01R 13/62

[52] U.S. Cl. ..... 339/89 C; 29/414; 29/416; 285/3; 339/177 E

[58] Field of Search ..... 339/177 R, 177 E, 89 R, 339/89 C, 90; 29/629, 413, 414, 418; 285/3, 4, 256, 382

[56] References Cited

U.S. PATENT DOCUMENTS

| | | | |
|---|---|---|---|
| 3,004,776 | 10/1961 | Sebardt | 285/3 |
| 3,171,707 | 3/1965 | Powell | 339/89 C X |
| 3,437,982 | 4/1969 | O'Keefe | 339/177 R |
| 3,537,065 | 10/1970 | Winston | 339/177 R |
| 3,646,502 | 2/1972 | Hutter et al. | 339/89 C |

*Primary Examiner*—Howard N. Goldberg
*Assistant Examiner*—Eugene F. Desmond
*Attorney, Agent, or Firm*—Sim & McBurney

[57] ABSTRACT

There is provided a connector which includes a body portion and a swivel nut. The swivel nut is originally integral with the body portion as machined, the location at which the two parts are integral being a relatively weak bridge portion which is capable of rupture to free the swivel nut. There are also provided distortable means which, after the rupture of the two main parts, can be distorted to capture the swivel nut axially with respect to the body portion.

5 Claims, 4 Drawing Figures

SWIVEL CONNECTOR

This invention relates generally to the connector art, and has to do particularly with a connector for a coaxial cable of the kind typically used in the television industry, the cable having a central conductor surrounded by a first sheath, in turn enwrapped by a filamented or interwoven conductor, in turn surrounded by a second sheath.

The manufacture of conventional swivel connectors of this kind is a complex matter, due to the fact that the connector must include two portions which are not integral with each other, but which are maintained together through a swivel connection. One of the parts may be referred to as the body portion, which is adapted to establish electrical connection with and be crimped onto the end of the coaxial cable. The other part is the swivel nut, which must be mounted on the body portion, for swivelling motion with respect thereto. The nut is adapted to be threaded onto the socket connector of the television set.

The necessity for having two separate but rotatably connected parts leads to considerable expense in the manufacture of these items. An important economy could be effected if the device could be manufactured as a single integral component initially, with a simple operation mechanically performed to rupture the item into two portions which are swivelably connected together.

It is an aspect of this invention to provide a connector meeting the description just given.

Accordingly, there is provided a connector for a coaxial cable of the kind which has a central conductor surrounded by a first insulative sheath, in turn enwrapped by a filamented conductor, in turn surrounded by a second insulative sheath, the connector comprising:

a conductive body defining an open-ended bore through which said first sheath can be received from one end of the bore, and a swivel nut at the other end of said bore formed initially integral with said body through a weak bridge portion capable of rupture to free the swivel nut, there being distortable means provided to capture the swivel nut with respect to the body after rupture.

Two embodiments of this invention are illustrated in the accompanying drawings, in which like numerals denote like parts throughout the several views, and in which.

Figure 1:
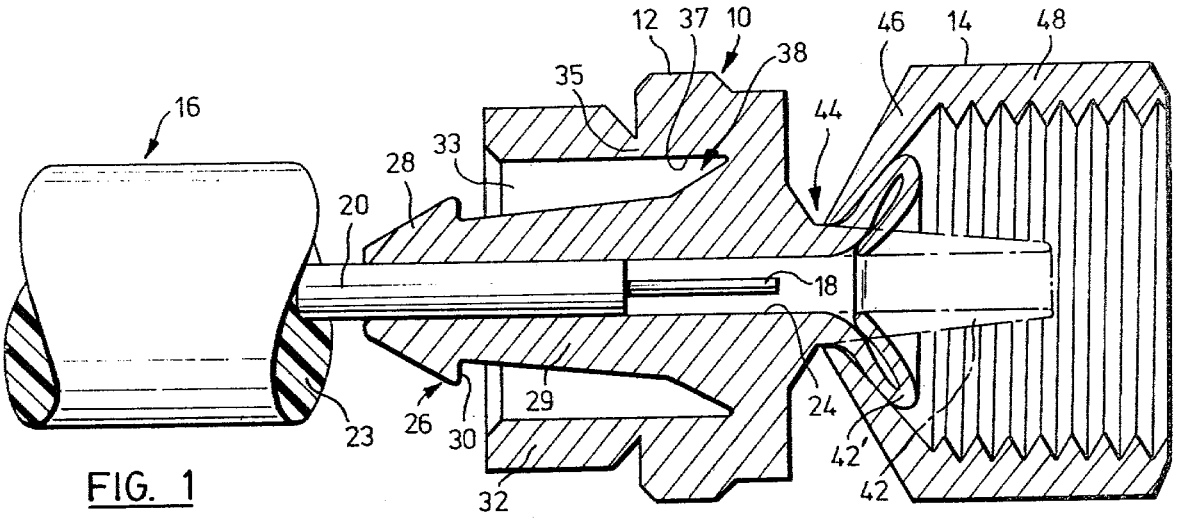
FIG. 1 is an axial sectional view of a swivel connector constructed in accordance with the first embodiment of this invention.

Attention is first directed to FIG. 1, in which a connector is shown at 10, and includes a body 12 and a swivel nut 14. The connector is intended for use with a coaxial cable 16, which includes a central conductor 18, surrounded by a first insulative sheath 20, which in turn is enwrapped by a filamented net-like conductor 21 (see FIG. 2), the latter being in turn surrounded by a second insulative sheath 23.

The body 12 of the connector defines an open-ended bore 24 through which the first sheath 20 can be received as shown in FIG. 1. The body 12 defines a sharpened configuration 26 through which the leftward end of the bore 24 opens. The sharpened configuration 26 includes an arrow-like part 28 and a barrel portion 29. The arrow-like part 28 has an outwardly projecting step 30, the usefulness of which will become apparent from what follows. Supported by the body 12 outwardly surrounding the sharpened configuration 26, in particular the barrel portion 29, is a means which is adapted to receive the second sheath 23 and to be crimped inwardly against the second sheath to bind the same in position with respect to the body 12. In particular, the means just mentioned includes a crimping ring 32 having a smooth cylindrical inner wall 33, and being joined to the body 12 at a relatively thin, rupturable portion 35. The cylindrical, smooth inner wall 33 is contiguous with the wall 37 of a recess 38 in the body portion 12, such that the space defined between the barrel portion 29 and the crimping ring 32 has the recess 38 as an extension.

Figure 2:
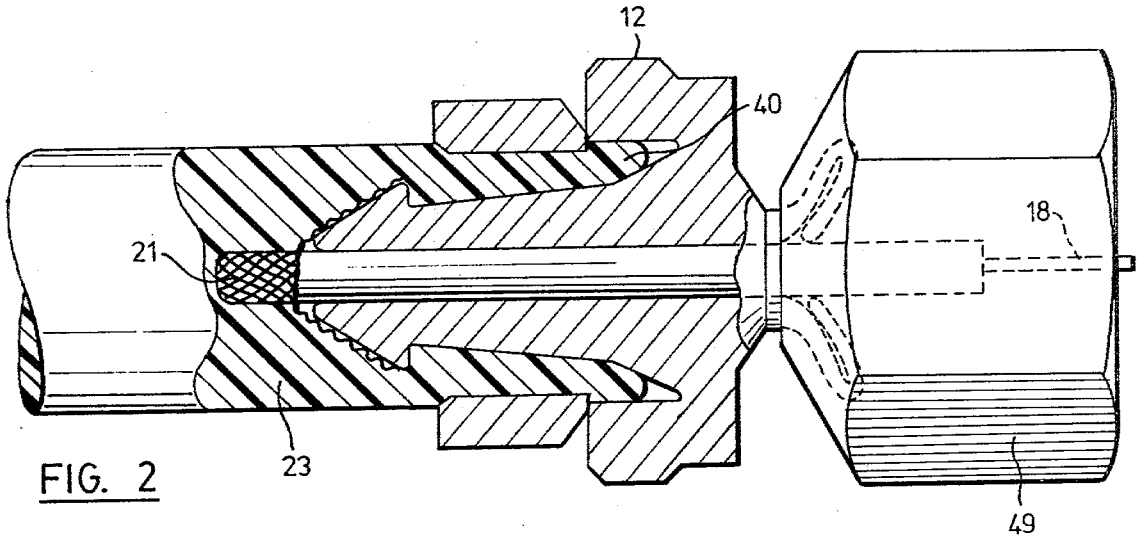
FIG. 2 is a partially sectioned view of the connector of FIG. 1, attached to a coaxial cable.

In assembly, the first step is usually to bare the central conductor 18 as shown in FIG. 1, by cutting back the first insulative sheath 20. The second insulative sheath 23 is cut back still further (leftwardly in the figures), so that as the first insulative sheath 20 and the protruding central conductor 18 are fed through the central bore 24, the arrow-like part 28 can engage around the insulative sheath 20 and inside or within the filamented conductor 21, as seen in FIG. 2. This will distort the second insulative sheath 23 outwardly as shown in FIG. 2, to allow it to pass around the arrow-like part 28, and the leading end 40 thereof will pass between the crimping ring 32 and the barrel portion 29 as seen in FIG. 2. When the leading end 40 has been shoved as far as possible to the right with respect to the body 12, a crimping tool is applied to the crimping ring 32, to permanently crimp or distort it inwardly to establish a fast grip around the sheath 23. This is clearly seen in FIG. 2. Because the arrow-like part 28 passes inside the filamented conductor 21, a good electrical contact is made between the filamented conductor 21 and the body 12.

As originally machined, the body 12 includes a rightwardly extending conical nose 42, which is shown in broken lines in FIG. 1. The rightward end of the internal bore 24 opens through the nose, and the nose is thus somewhat in the shape of a nozzle with relatively thin walls. This is clear from FIG. 1. Also, in the as-machined state, the swivel nut 14 is integral with and thus securely affixed to the body 12. The nut 14 is integral at the location 44 which is the inner extremity of a conical portion 46 of the swivel nut 14. The swivel nut 14 also includes an internally threaded portion 48 of standard configuration. It will be noted in FIG. 1 that the conical portion 46 narrows down as it proceeds inwardly toward the contact location 44, such that the actual bridge of material between the swivel nut and the body 12 is relatively thin and easily ruptured. After the connector has been machined, a separate operation is carried out to accomplish two things simultaneously. The first is to rupture the swivel nut/body connection at the location 14, simply by shearing the connection through force exerted in a horizontal direction as viewed in FIG. 1. The second is to deform or "upset"

the nose 42 so that it takes up the shape drawn at 42' in solid lines in FIG. 1. As can be seen, the shape at 42' is bent or distorted outwardly, in order to provide a portion of wider diameter in order to maintain the swivel nut in association with the body 12, while permitting the same to rotate relatively thereto. As seen in FIG. 2, the swivel nut 14 has a hexagonal outer surface identified at 49.

Figure 3:
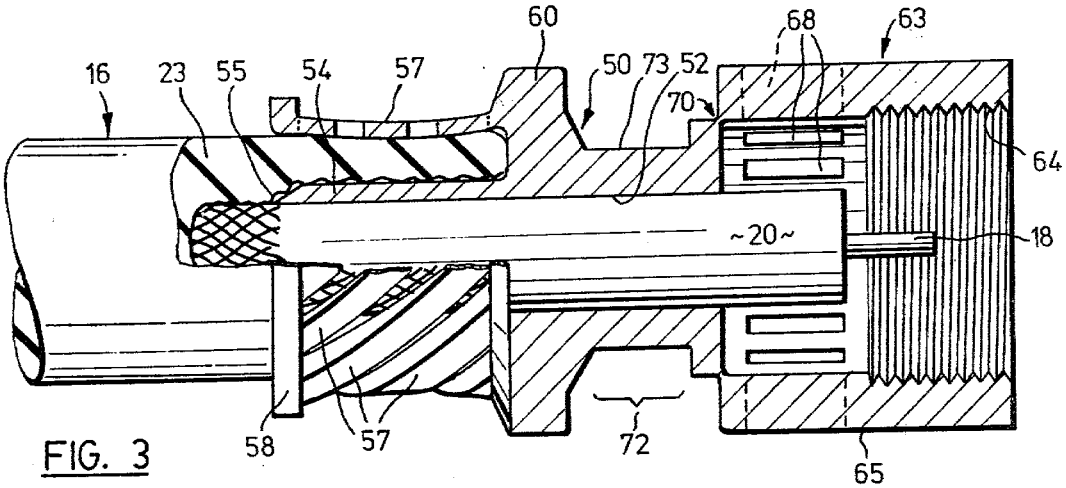
FIG. 3 is an axial sectional view of a swivel connector in accordance with the second embodiment of this invention, as initially manufactured.
Figure 4:
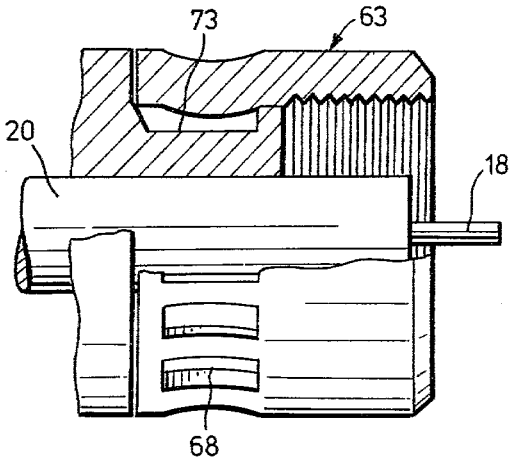
FIG. 4 is a partial view similar to that of FIG. 3, showing the second embodiment after rupture of the two parts, so that one is capable of swivelling with respect to the other.

Attention is now directed to FIGS. 3 and 4, which illustrate the second embodiment of this invention. Again, as in the first embodiment, the item is machined as a single integral unit initially, and a subsequent machining operation ruptures or severs it into two distinct portions, one constituting the swivel nut, the other the body portion which makes contact with the end of the coaxial cable.

In FIG. 3, a body 50, again made of brass or similar electrically conductive material, defines a central, open-ended bore 52 which is surrounded at the leftward end by a sharpened configuration 54 having a bevelled leftward end 55. The body 50 supports, outwardly of the sharpened configuration, means which is adapted to receive the second sheath 23 of the coaxial cable 16, and to be crimped inwardly against the second sheath to bind the same in position with respect to the body 50. The means in question is constituted by a plurality of helically disposed ribs 57 extending between a ring formation 58 and a flange portion 60 of the body 50.

The helical ribs 57 may be formed in a two-step operation, involving firstly the use of a helical knurling tool to impress relatively deep helical grooves into a cylindrical portion terminating in the ring 58, without cutting the grooves all the way through to the inside, and secondly a machining operation in which a certain thickness of the wall is removed from the inside, thus cutting away the bottoms of the grooves made by knurling, and leaving the helical ribs separated from one another.

After the two-step operation just described, the body 50 is ready to be connected to the end of a coaxial cable 16. As in the first embodiment, the rightward end of the central conductor 18 is bared by cutting the first sheath 20 back, and then the latter is passed through the central bore 52 while at the same time the second or outer insulating sheath 23 is inserted over the sharpened configuration 54 and under or within the helical ribs 57 to the position shown in FIG. 3. During this portion of the operation, the sharpened configuration 54 passes inside the filamented conductor as can be seen in FIG. 3. Then, the helical ribs 57 are crimped inwardly with any suitable crimping tool, so as to squeeze or grip the rightward end of the outer sheath 23 in the manner shown in FIG. 3.

The rightward end of the item as manufactured and prior to being ruptured into two separate pieces includes a swivel nut 63 having internal teeth 64 and typically a hexagonal configuration on the outside 65. Essentially, the swivel nut 63 is in a straight cylindrical configuration (except for the hexagonal outer faces), and includes at its leftward end a plurality of machined, radial slots 68 which provide a location of weakness or less resistance to crimping. Finally, at the furthest leftward edge, the swivel nut 63 is attached to the body 50 at a location 70 through a very small "bridge" which is easily ruptured.

In the rupturing operation, the swivel nut 63 is driven leftwardly with respect to the body 50 so that the portion containing the slots 68 is adjacent a region shown at the numeral 72 of the body 50, which provides a circumferential recess 73 into which the inwardly distortable ribs defined between the slots 68 can be deformed, as shown in FIG. 4.

Thus, the swivel nut 63 will be retained axially with respect to the body 50 while being permitted to rotate with respect thereto.

It will be appreciated from the foregoing that the automatic manufacture of the item disclosed herein can include a machining step which will accomplish the rupture of the swivel nut from the body, and another for the inward distorting or crimping of the part of the nut required to capture the nut axially with respect to the body.

Thus the item can come from a multi-stage machine such as an Automatic Screw Machine completely assembled and in operational condition. At present, the conventional manufacturing process involves machining the body and the swivel nut separately, stocking these separately, then cleaning the parts and putting them into an assembling machine. All of these steps represent time and costs which can be spared by employing the invention disclosed herein.

I claim:

1. A connector for a coaxial cable of the kind which has a central conductor surrounded by a first insulative sheath, in turn enwrapped by a filamented conductor, in turn surrounded by a second insulative sheath, the connector comprising:

a conductive body defining an open-ended bore through which said first sheath can be received from one end of the bore, and a swivel nut at the other end of said bore formed initially integral with said body through a weak bridge portion capable of rupture to free the swivel nut, there being distortable means provided to capture the swivel nut with respect to the body after rupture.

2. The connector claimed in claim 1, in which said one end of the bore opens through a sharpened configuration adapted for insertion between said first sheath and said filamented conductor, the connector further including means supported by said body outwardly of said sharpened configuration, said means being adapted to receive said second sheath and to be crimped inwardly against said second sheath to bind the same in position with respect to said body.

3. The connector claimed in claim 1 or claim 2, in which said swivel nut has an internally threaded portion and a conical portion converging from one end of the threaded portion to a location of rupturable attachment to the body adjacent to and surrounding an intermediate region of the bore, the bore from said region to the said other end being defined by a distortable, thin-walled tube integral with the body, and capable of being upset to an expanded shape adapted to retain the swivel nut in position on the body once the attachment between the body and nut has been ruptured.

4. The connector claimed in claim 1 or claim 2, in which said swivel nut has an internally threaded portion and a further portion adjacent said threaded portion, the nut being rupturably attached to said body at the end of said further portion remote from said threaded portion, said further portion having inwardly distortable means which when distorted inwardly decrease the effective inner diameter of said further portion, the part of the body to which said further portion is initially attached being of an outer diameter slightly less than said inner diameter, and having an adjacent circumferential inward recess into which the said inwardly distortable means can project without binding, after the swivel nut has been ruptured from the body and moved axially in the direction toward the body.

5. A connector comprising:

a body, and a swivel nut integral with said body through a weak bridge portion capable of rupture to free the swivel nut, there being distortable means provided to capture the swivel nut with respect to the body after rupture, said swivel nut having an internally threaded portion and a further portion adjacent said threaded portion, the nut being rupturably attached to said body at the end of said further portion remote from said threaded portion, said further portion having inwardly distortable means which when distorted inwardly decrease the effective inner diameter of said further portion, the part of the body to which said further portion is initially attached being of an outer diameter slightly less than said inner diameter, and having an adjacent circumferential inward recess into which the said inwardly distortable means can project without binding, after the swivel nut has been ruptured from the body and moved axially in the direction toward the body.

* * * * *